US007059287B2

(12) United States Patent
Speil et al.

(10) Patent No.: US 7,059,287 B2
(45) Date of Patent: Jun. 13, 2006

(54) SWITCHED CAM FOLLOWER OR SWITCHED SUPPORT ELEMENT OF A VALVE GEAR OF AN INTERNAL COMBUSTION ENGINE

(75) Inventors: Walter Speil, Ingolstadt (DE); Henning Karbstein, Strullendrof (DE)

(73) Assignee: INA Schaeffler KG (DE)

( * ) Notice: Subject to any disclaimer, the term of this patent is extended or adjusted under 35 U.S.C. 154(b) by 0 days.

(21) Appl. No.: 10/501,775

(22) PCT Filed: Jan. 10, 2003

(86) PCT No.: PCT/EP03/00158

§ 371 (c)(1),
(2), (4) Date: Jul. 20, 2004

(87) PCT Pub. No.: WO03/060294

PCT Pub. Date: Jul. 24, 2003

(65) Prior Publication Data

US 2005/0028776 A1 Feb. 10, 2005

(30) Foreign Application Priority Data

Jan. 18, 2002 (DE) ..... 102 01 805

(51) Int. Cl.
*F01L 1/14* (2006.01)

(52) U.S. Cl. ..... 123/90.48; 123/90.52; 123/90.55; 123/90.12

(58) Field of Classification Search ..... 123/90.48, 123/90.59
See application file for complete search history.

(56) References Cited

U.S. PATENT DOCUMENTS 4,112,884 A * 9/1978 Tominaga ..... 123/90.48
5,992,360 A * 11/1999 Elendt et al. ..... 123/90.16
6,273,041 B1 8/2001 Haas
6,321,705 B1 11/2001 Fernandez

FOREIGN PATENT DOCUMENTS

| | | |
|---|---|---|
| DE | 197 28 100 A1 | 1/1999 |
| DE | 198 01 701 A1 | 7/1999 |
| DE | 199 13 290 A1 | 9/2000 |
| DE | 101 02 130 A1 | 7/2002 |
| DE | 101 19 366 A1 | 10/2002 |
| EP | 0 323 234 | 7/1989 |

* cited by examiner

*Primary Examiner*—Thomas Denion
*Assistant Examiner*—Kyle M. Riddle
(74) *Attorney, Agent, or Firm*—Charles A. Muserlian

(57) ABSTRACT

A switchable cam follower (1) or a switchable support element of a valve train of an internal combustion engine, said cam follower or support element comprising an outer part (2) which is assembled together with an inner part (4) that is displaceable relative thereto in a direction of cam lift, said inner part (4) comprising, at a parting gap (5) to the outer part (2), two spaced apart or opposing openings (6, 7) for coupling means, each of said openings (6, 7) being aligned, at one cam position, to a further opening (10, 11) for coupling means in the outer part (2), the coupling means being configured and arranged so that, in a coupled state, each coupling means extends beyond the parting gap (5) on one coupling side (12, 13) while simultaneously extending in the opening (10, 6) of the outer and the inner part (2, 4) which in an uncoupled position of the coupling means (14, 15), an axial idle stroke of the coupling means (15) on the one coupling side (12) till coupling is achieved is large and the axial idle stroke of the coupling means (14) on the further coupling side (13) till coupling is achieved is small. In this way, a switchable cam follower (1) or a switchable support element is crated in which the manufacturing costs, the complexity and also the risk of faulty couplings are drastically reduced.

5 Claims, 1 Drawing Sheet

SWITCHED CAM FOLLOWER OR SWITCHED SUPPORT ELEMENT OF A VALVE GEAR OF AN INTERNAL COMBUSTION ENGINE

This application is the national stage of PCT/EP03/00158 filed Jan. 10, 2003.

FIELD OF THE INVENTION

The invention concerns a switchable cam follower or a switchable support element of a valve train of an internal combustion engine, said cam follower or support element comprising an outer part which is assembled together with an inner part that is displaceable relative thereto in a direction of cam lift, said inner part comprising, at a parting gap to the outer part, two spaced apart or opposing openings for coupling means, each of said openings being aligned, at one cam position, to a further opening for coupling means in the outer part, the coupling means being configured and arranged so that, in a coupled state, each coupling means extends beyond the parting gap on one coupling side while simultaneously extending in the opening of the outer and the inner part.

BACKGROUND OF THE INVENTION

A cam follower of the pre-cited type configured as a bucket tappet is known from DE 198 01 701 A1. A drawback of this cam follower is that both its coupling sides have to be manufactured extremely exactly with respect to the idle stroke of the two coupling means and with respect to the radial clearance and a tolerance of the radial clearance. Likewise, only the smallest possible shape deviations are allowed. Thus, a switchable cam follower in keeping with the above requirements has a relatively complex structure and therefore also causes high manufacturing costs. At the same time, the system-related risk at the two coupling sides increases due to the double precision required.

OBJECTS OF THE INVENTION

The object of the invention is to provide a cam follower or a support element of the pre-cited type that eliminates the mentioned drawbacks.

SUMMARY OF THE INVENTION

The invention achieves the above object by the fact that in an uncoupled position of the coupling means, an axial idle stroke of the coupling means on the one coupling side till coupling is achieved is large and the axial idle stroke of the coupling means on the further coupling side till coupling is achieved is small.

Alternatively to or in conjunction with the above measures, a further subject matter of the invention is that, in a coupled state of the coupling means, a radial clearance of the coupling means, alone or together with a tolerance of the radial clearance relative to its opening, is large on the one coupling side and small on the further coupling side.

Thus, the increased manufacturing work discussed above is required only on the one coupling side while the further coupling side does not need such fine finishing with regard to the axial idle stroke and the radial clearance. Manufacturing work and costs can therefore be drastically reduced without an appreciable effect on the properties of the cam follower or the support element.

The coupling of the invention according to the first solution is designed so that the coupling means on the further, finely toleranced coupling side is always the first to extend in the corresponding opening. The hitherto possible adverse effect of a faulty switching, for example if the coupling means is not sufficiently extended despite an imparted coupling command, with the result that the coupling means slips out and the load-bearing component is strongly overloaded, is no longer possible. It is thus the coupling means on the further coupling side that positively bears the load at first when the coupling command is imparted, and only then the coupling means on the one coupling side.

According to a further proposition of the invention, in the case of rotationally symmetric cam followers such as bucket tappets, roller tappets or rotationally symmetric support elements, at least one edge of the opening on the one, coarsely toleranced coupling side, is left simply cylindric. The edge for the coupling means on the other, finely toleranced coupling side can be flattened as proposed by the invention, but this is not compulsory. In this way, again, manufacturing costs for fabricating a flat surface at least on the one coupling side are saved. On the further coupling side with the flat surface and a sufficiently long traveling path of the respective coupling means beyond the edge of the fore-positioned opening, the coupling means is immediately surrounded all round and thus has excellent load-bearing properties.

A further contribution to minimizing the manufacturing costs is obtained if, as mentioned above, the radial clearance, for example, together with a tolerance of the radial clearance of the coupling means, is large on the one coupling side and small on the further coupling side. The clearance is considered here as the idle travel path of the coupling means within its opening (cam lift direction). However, as soon as the small radial clearance on the "fine" coupling side has been overcome, a desired lift transmission takes place. Thus, the radial clearance on the coarsely toleranced coupling side is not determinative. This only brings about a slightly increased tilting of the outer part relative to the inner part which can be accepted.

The scope of the invention extends particularly to switchable cam followers like the aforesaid bucket tappets but also to roller and mushroom tappets for activating tappet push rods, to lever-type cam followers, to switching bridge members for activating a plurality of identically operating gas exchange valves and to switchable support elements, in so far as a two-sided coupling mechanism is used.

The scope of the invention further extends to switchable valve train elements in which it is not an assembly of slides that is moved in one single direction but in which two similar coupling means are provided, for example in the inner part, and are displaced radially outwards beyond the parting gap for achieving coupling.

According to a further advantageous feature of the invention, the openings are made as bores and the coupling means as piston-like slides. However, it is also conceivable to configure the openings differently, for example with multiple edges, so that many different types of coupling means will occur to a person skilled in the art to replace the slides, for instance wedges, balls or the like.

According to another feature of the invention, separate sleeves are provided which eliminate the need for a complex fine finishing of the slide ways for the coupling means on the cam follower, According to still another feature of the invention, the outer part is annular in shape and the inner part is arranged in the bore of the outer part. It is, however, clear that the scope of the invention is not limited only to rotationally symmetric cam followers and support elements. Thus, for example, cam follower components, such as levers, arranged next to each other are also covered by the invention.

A preferred cam position for the displacement of the coupling means is a base circle contact of the associated cam or cams, but other positions of lift are also conceivable in this connection.

The openings for the coupling means in the outer part are preferably situated diametrically opposite each other. However, the invention also covers an offset positioning of the openings in peripheral or vertical direction. It is also conceivable not to make the opening in the inner part as a through-bore but to provide pocket bores.

Finally, it is also in keeping with the invention to omit the flattening of the one edge if the corresponding coupling means is secured against rotation in its opening and its front end in coupling direction has a geometry that is complementary to the opposing surface.

BRIEF DESCRIPTION OF THE DRAWING

The invention will now be described more closely with reference to the appended drawing.

DETAILED DESCRIPTION OF THE DRAWING

Figure 1:
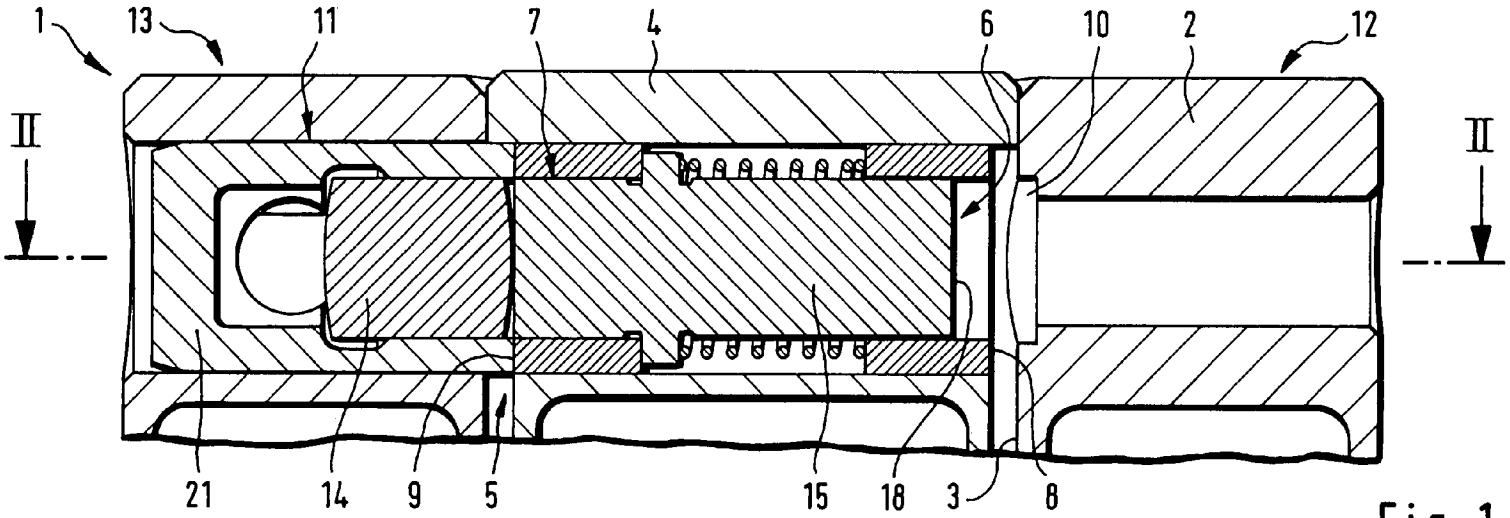
FIG. 1 is a longitudinal section through a bottom region of a switchable cam follower of the invention configured as a bucket tappet.
Figure 2:
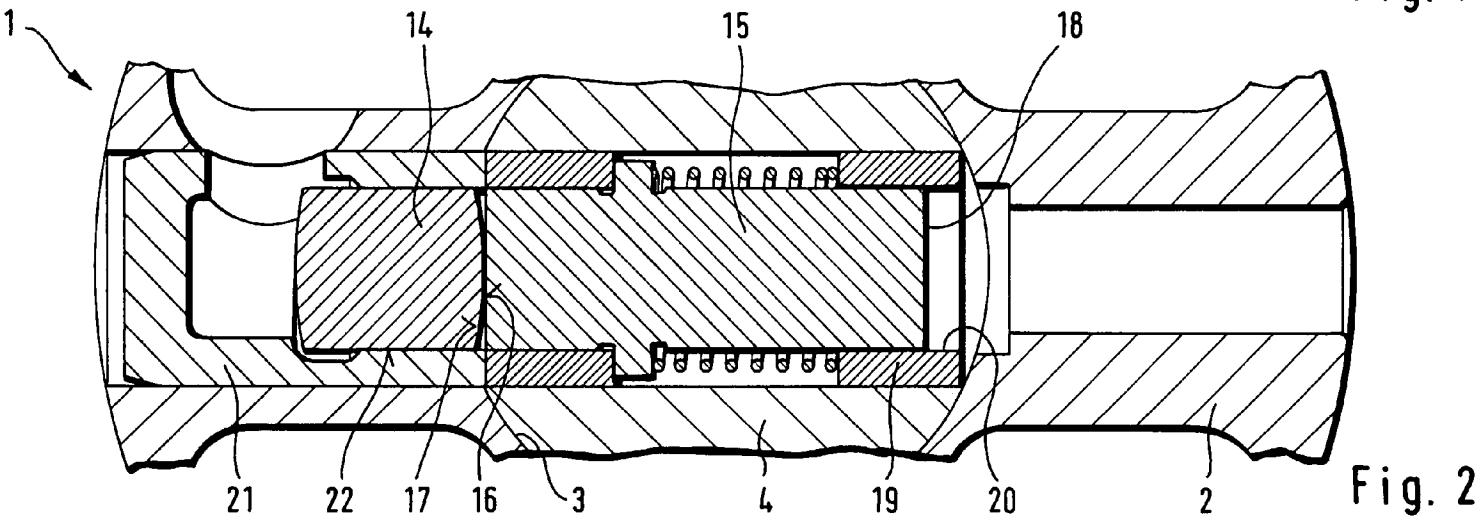
FIG. 2 is a section along line II—II of FIG. 1.

The Structure:

As disclosed in the two figures, the cam follower 1 comprises a cylindrical outer part 2 in whose bore 3 an inner part 4 is arranged for relative axial displacement thereto. An annular parting gap 5 extends between the inner and the outer part 4, 2. The inner part 4 has two diametrically opposite openings 6, 7 that merge together to form a through-bore. Both openings 6, 7 have an edge 8, 9. Aligned to each edge 8, 9 in one cam position (here base circle contact run) is situated an opposing further opening 10, 11 for coupling means to be described later. In the uncoupled state, the opening 10 on one coupling side 12 does not comprise any coupling means, whereas, in the opening 11 on a further coupling side 13 is positioned a coupling means 14 configured as a piston-like slide.

A coupling means 15 configured as a piston-like slide is arranged in the inner part 4. It can be seen that the coupling means 15 bears through one of its end faces 16 directly against a crowned front end 17 of the other coupling means 14 in the uncoupled state shown in the figures (cam base circle contact run). In the region of the one coupling side 12, in contrast, a further end face 18 of the coupling means 15 is configured so as to be spaced from the parting gap 5.

A person skilled in the art will further see in the figures that in the openings 6, 7 of the inner element 4 that merge to form a through-bore is mounted a sleeve-like body 19, and the coupling means 15 extends directly in the bore 20 of this sleeve-like body 19. Similarly, the opening 11 on the further coupling side 13 also comprises a sleeve-like body 21 for the coupling means 14 which extends directly in the bore 22 of this sleeve-like body 21. Upon a sufficient coupling movement of the coupling means 14 into the opening 7, the edge 9 on the sleeve-like body 19 surrounds the coupling means 14 annularly, that is to say, all round. On the opposite one coupling side 12, in contrast, this advantage does not exist but, as elucidated below, this can be accepted without any problem.

The Function:

It can be seen from both figures that in the shown uncoupled position of the coupling means 14, 15 that are positioned aligned behind each other in the form of a slide assembly, an idle stroke of the coupling means 15 on the one coupling side 12 into the opening 10 till coupling is achieved is clearly larger than the idle stroke of the coupling means 14 on the further coupling side 13 till it is reliably displaced past the edge 9 and the parting gap 5 into the opening 7 of the inner element 4. Thus load is supported in any case at first on the further coupling side 13 before a reliable coupling is realized on the one coupling side 12. In other words, the distances covered by the coupling means 14, 15 for coupling are dimensioned so that it is always the coupling means 14 on the further coupling side 13, which is finely toleranced with regard to the axial idle stroke, that is the first to support load. The one coupling side 12 that is clearly more coarsely toleranced couples only later. It is never possible for the "coarse" one coupling side 12, that is cylindrically curved at the edge of the opening 10, to be the first to support load. Because, in this way, the precise, further coupling side 13 that is displaced into the optionally flat edge 9 of the opening 7 is coupled at first, it is no longer possible for the coupling means 15 to slip out of the merely cylindrical edge of the opening 10 that has only low load-bearing properties.

In this way, an increased component loading at discrete points of the coupling means 14, 15 is avoided without recourse to special measures. Due to the fact that only the further coupling side 13 is exactly configured with regard to the axial idle stroke, costs of manufacturing as well as the system-related risk in the coupling mechanism are drastically reduced. In addition, the complexity of the structure is also reduced.

Further, a radial clearance and a tolerance of the radial clearance of the coupling means 14 on the further coupling side 13 can be precisely dimensioned, whereas a radial clearance and a tolerance of the radial clearance of the coupling means 15 on the one coupling side 12 is coarsely dimensioned. If desired, even the shape deviation can be toleranced as described above. The coarser dimensioning of the radial clearance on the one coupling side 12 results only in a slightly increased tilting of the outer part 2 relative to the inner part 4 in the coupled state. The radial play is determined by the further, finely toleranced coupling side 13. In this way, a transmission of lift takes place immediately after the coupling means 14 on the finely toleranced coupling side 13 has completed its very minimal idle stroke in cam-distal direction within the opening 7 of the inner element 4.

LIST OF REFERENCE NUMERALS

1 Cam follower
2 Outer part
3 Bore
4 Inner part
5 Parting gap
6 Opening
7 Opening
8 Edge
9 Edge
10 Opening
11 Opening
12 Coupling side

13 Coupling side
14 Coupling means
15 Coupling means
16 End face
17 Front end
18 End face
19 Body
20 Bore
21 Body
22 Bore

The invention claimed is:

1. A switchable cam follower (1) or a switchable support element of a valve train of an internal combustion engine, said cam follower or support element comprising an outer part (2) which is assembled together with an inner part (4) that is displaceable relative thereto in a direction of cam lift, said inner part (4) comprising, at a parting gap (5) to the outer part (2), two spaced apart or opposing openings (6, 7) for coupling means, each of said openings (6, 7) being aligned, at one cam position, to a further opening (10, 11) for coupling means in the outer part (2), the coupling means being configured and arranged so that, in a coupled state, each coupling means extends beyond the parting gap (5) on one coupling side (12, 13) while simultaneously extending in the opening (10, 6) of the outer and the inner part (2, 4) wherein in an uncoupled position of the coupling means (14, 15), an axial idle stroke of the coupling means (15) on the one coupling side (12) till coupling is achieved is large and the axial idle stroke of the coupling means (14) on the further coupling side (13) till coupling is achieved is small, the one cam position is determined by a base circle contact of the cam or cams wherein in a coupled state of the coupling means (14, 15), a radial clearance of the coupling means (15), alone or together with a tolerance of the radial clearance relative to its opening (10) on the one coupling side (12) is large and relative to its opening (7) on the further coupling side (13) is small.

2. A cam follower or a support element of claim 1, wherein sleeve-like bodies (21, 19) are mounted in the openings (11, 6 and 7) in which the coupling means (14, 15) extend in case of uncoupling, and the coupling means (14, 15) are arranged directly in bores (22, 20) of the sleeve-like bodies (21, 19).

3. A switchable cam follower (1) or a switchable support element of a valve train of an internal combustion engine, said cam follower or support element comprising an outer part (2) having an annular configuration which is assembled together with an inner part (4) extending into a bore (3) of outer part (2) that is displaceable relative thereto in a direction of cam lift, said inner part (4) comprising, at a parting gap (5) to the outer part (2), two spaced apart or opposing openings (6,7) for coupling means, each of said openings (6, 7) being aligned, at one cam position, to a further opening (10, 11) for coupling means (14, 15) in the outer part (2), the openings (6, 7, 10, 11) are configured as bores, the coupling means being configured as piston-like slides and arranged so that, in a coupled state, each coupling means extends beyond the parting gap (5) on one coupling side (12, 13) while simultaneously extending in the opening (10, 6) of the outer and the inner part (2, 4) wherein in an uncoupled position of the coupling means (14, 15), an axial idle stroke of the coupling means (15) on the one coupling side (12) till coupling is achieved is large and the axial idle stroke of the coupling means (14) on the further coupling side (13) till coupling is achieved is small, the one cam position is determined by a base circle contact of the cam or cams, the openings (6, 7, 10, 11) are configured as bores and the coupling means (15, 14) are configured as piston-like slides and the outer part (2) has an annular configuration, and the inner part (4) extends in a bore (3) of the outer part (2).

4. A cam follower or a support element of claim 3, wherein only one edge (9) of the opening (7) for the coupling means (14) on the further coupling side (13), into which opening (7) the coupling means (14) penetrates for coupling, is made as a flat surface.

5. A cam follower or a support element of claim 3 wherein a slide assembly comprising a total of two coupling means (14, 15) is used, the openings (6, 7) in the inner part (4) merge together to form a through-bore within which the one coupling means (15) extends at least almos over an entire length thereof, the further coupling means (14) is arranged in the opening (11) of the further coupling side (13) and comprises, radially inwards, a crowned front end (17) serving as a contact surface for one end face (16) on the one coupling means (15) in the inner part (4), and, in case of uncoupling, the front end (17) bears against the end face (16 during the one cam position.

* * * * *